US007109841B2

(12) United States Patent
Haga et al.

(10) Patent No.: US 7,109,841 B2
(45) Date of Patent: Sep. 19, 2006

(54) SURFACE-MOUNT POSITIVE TEMPERATURE COEFFICIENT THERMISTOR AND MANUFACTURING METHOD THEREFOR

(75) Inventors: Takeo Haga, Omihachiman (JP); Hiroki Tanaka, Yokaichi (JP); Toshiharu Hirota, Hikone (JP); Hiroshi Kuwahara, Omihachiman (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 290 days.

(21) Appl. No.: 10/395,143

(22) Filed: Mar. 25, 2003

(65) Prior Publication Data

US 2003/0217458 A1 Nov. 27, 2003

(30) Foreign Application Priority Data

Mar. 26, 2002 (JP) ..... 2002-086453
Feb. 20, 2003 (JP) ..... 2003-043091

(51) Int. Cl.
*H01C 7/10* (2006.01)

(52) U.S. Cl. ..... 338/22 R; 338/22 SD; 338/232

(58) Field of Classification Search ..... 338/22 R, 338/22 SD, 232, 234, 235, 236
See application file for complete search history.

(56) References Cited

U.S. PATENT DOCUMENTS 4,959,505 A * 9/1990 Ott ..... 338/22 R
5,760,336 A * 6/1998 Wang ..... 333/22 R
5,963,423 A * 10/1999 Ikeda ..... 338/22 R
5,990,779 A * 11/1999 Katsuki et al. ..... 338/232

FOREIGN PATENT DOCUMENTS

| | | | |
|---|---|---|---|
| JP | 08-031604 | | 2/1996 |
| JP | 08-55703 | * | 8/1996 |
| JP | 09-232104 | | 9/1997 |

OTHER PUBLICATIONS

Machine translation to 08031604, Katsuki et al. Feb. 1996.*
Official Communication issued in the corresponding Chinese Application No. 03107284.4 dated Nov. 4, 2005.

* cited by examiner

*Primary Examiner*—Tu Hoang

(57) ABSTRACT

A surface-mount positive temperature coefficient thermistor includes a disk-shaped positive temperature coefficient thermistor element having electrodes provided on opposing main surfaces thereof, an insulating case having an inner space with the thermistor element inserted therein, and a pair of metal terminals arranged to make electrical contact with the respective main surface electrodes of the thermistor element, and to sandwich therebetween the thermistor element. The insulating case includes a pair of main surfaces that are substantially parallel to the main surfaces of the thermistor element, a pair of opening side surfaces each having an opening, and a pair of end surfaces each having a terminal insertion hole provided therein. One end of each of the pair of metal terminals is inserted from the respective terminal insertion holes into the inner space, and the metal terminals press-hold the thermistor element so as to sandwich the thermistor element therebetween.

22 Claims, 23 Drawing Sheets

SURFACE-MOUNT POSITIVE TEMPERATURE COEFFICIENT THERMISTOR AND MANUFACTURING METHOD THEREFOR

BACKGROUND OF THE INVENTION

1. Field of the Invention

The present invention relates to a positive temperature coefficient thermistor, and in particular, to a surface-mount positive temperature coefficient thermistor and a manufacturing method therefor.

2. Description of the Related Art

Various chip-type positive temperature coefficient thermistors capable of being surface-mounted on a printed circuit board used for the purpose of overcurrent protection have been proposed.

FIG. 21 is a sectional view showing a structural example of a conventional surface-mount positive temperature coefficient thermistor (Japanese Unexamined Patent Application Publication No. 9-232104). The surface-mount positive temperature coefficient thermistor 1 shown in FIG. 21 is formed by inserting a positive temperature coefficient thermistor element 5 having electrodes 4*a* and 4*b* provided on a respective one of the opposite main surfaces thereof, into a resin case 3*a* having a locking portion with a lead terminal 2*a* insert-molded therein, and hermitically sealing the positive temperature coefficient thermistor element 5 using a cover resin case 3*b* having another lead terminal 2*b* insert-molded therein. The electrodes 4*a* and 4*b* on the opposite main surfaces of the positive temperature coefficient thermistor element 5 and the lead terminals 2*a* and 2*b*, respectively, are brought into pressure contact with each other to establish the electrical connection therebetween.

FIG. 22 is a front view showing another structural example of a conventional surface-mount positive temperature coefficient thermistor (Japanese Unexamined Patent Application Publication No. 8-031604). The surface-mount positive temperature coefficient thermistor 11 shown in FIG. 22 is formed by inserting one terminal 13*a* into a space on the top-surface side within a case 12 of which three side surfaces thereof are open, inserting the other terminal 13*b* into a space on the grounding bottom-surface side within the case 12, and inserting a positive temperature coefficient thermistor element 14 between the pair of terminals 13*a* and 13*b*. The pair of terminals 13*a* and 13*b*, and the electrodes 15*a* and 15*b* on the positive temperature coefficient thermistor element 14, respectively, are in pressure contact to establish the electrical connection therebetween.

With the surface-mount positive temperature coefficient thermistor 1 shown in FIG. 21, (1) the manufacturing costs increase since the lead terminals 2*a* and 2*b*, respectively, are fixed to the case 3*a* and 3*b* by insert-molding; (2) the orientation of the lead terminals 2*a* and 2*b* is inconveniently determined by fixing the lead terminals 2*a* and 2*b*, respectively, to the case 3*a* and 3*b* by insert-molding; and (3) two cases 3*a* and 3*b* for the locking portion and cover portion are required in order to bring the positive temperature coefficient thermistor element 5 and the lead terminals 2*a* and 2*b* into pressure contact with each other.

On the other hand, in the surface-mount positive temperature coefficient thermistor 11 shown in FIG. 22, the terminals 13*a* and 13*b* are merely inserted into the case 12, that is, there is no need to insert-mold the terminals 13*a* and 13*b*, unlike the case of the surface-mount positive temperature coefficient thermistor 1 shown in FIG. 21. Also, it is unnecessary to use two cases in order to bring the thermistor element 14 and the terminals 13*a* and 13*b* into pressure contact.

However, with the surface-mount positive temperature coefficient thermistor 11 shown in FIG. 22, (1) since the three side surfaces thereof are open, the case 12 has reduced strength, and hence, the thickness of the case must be increased in order to maintain sufficient strength; and (2) since the position from which the terminal 13*a* is inserted into the case 12 is limited to one side surface, the arrangement of the terminals 13*a* and 13*b* is severely restricted, and thereby the orientation of the case when performing surface mounting is severely restricted.

SUMMARY OF THE INVENTION

To overcome the problems described above, preferred embodiments of the present invention provide a surface-mount positive temperature coefficient thermistor that includes a disk-shaped positive temperature coefficient thermistor element having electrodes provided on a respective opposing main surfaces thereof, and an insulating case that includes an inner space with the positive temperature coefficient thermistor element inserted therein, and in which a pair of metal terminals are inserted. The pair of metal terminals are arranged to make electrical contact with the respective main surface electrodes of the positive temperature coefficient thermistor element, and to sandwich therebetween the positive temperature coefficient thermistor element, in the inner space. The insulating case includes a pair of main surfaces that are substantially parallel to the opposite main surfaces of the positive temperature coefficient thermistor element disposed in the inner space, a pair of open side surfaces each having an open portion where the insulating case is exposed to the outside, and a pair of end surfaces each including a terminal insertion hole provided therein. One end portion of each of the pair of metal terminals is inserted into the inner space from a respective one of the terminal insertion holes provided in the pair of end surfaces of the insulating case, and the other end of each of the pair of metal terminals extends up to one of the main surfaces along the outer wall surface of the insulating case.

In the surface-mount positive temperature coefficient thermistor according to preferred embodiments of the present invention, preferably, the terminal insertion holes are provided in two portions in the pair of end surfaces of the insulating case.

In the surface-mount positive temperature coefficient thermistor according to preferred embodiments of the present invention, an extension portion extending from one of the pair of main surfaces is preferably provided on each of the sides of the pair of opening side surfaces of the insulating case, and a protrusion is preferably provided at the front end of each of the extension portions. The protrusions are preferably arranged at positions that are point-symmetrical with respect to the center of the positive temperature coefficient thermistor element.

In the surface-mount positive temperature coefficient thermistor according to preferred embodiments of the present invention, it is preferable that an extension portion extending from one of the pair of main surfaces and an extension portion extending from the other of the pair of main surfaces be each disposed on the side of a respective one of the sides of the opening side surfaces of the insulating case, and that a protrusion is provided at the front end of each of the extension portions. The protrusions are preferably provided at locations that are line-symmetrical with respect to the center line that passes one end surface of the insulating case, the center of the positive temperature coefficient thermistor element, and the other end surface of the insulating case.

In the surface-mount positive temperature coefficient thermistor according to preferred embodiments of the present invention, preferably, locking portions that make contact with the side surface of the positive temperature coefficient thermistor element in order to position the positive temperature coefficient thermistor element, are provided within the insulating case or/and on one of the pair of metal terminals.

In the surface-mount positive temperature coefficient thermistor according to preferred embodiments of the present invention, it is preferable that, at least one of the locking portions provided within the insulating case is a projection that is provided on the inner wall surface of the insulating case, and that the projection is provided at a location that is opposed to the side surface of the positive temperature coefficient thermistor element. It is also preferable that, at least one of the locking portions provided on the metal terminal is a folded portion or cut-and-raised portion, and that the folded portion or cut-and-raised portion is provided at a location that is opposed to the side surface of the positive temperature coefficient thermistor element.

In the surface-mount positive temperature coefficient thermistor according to preferred embodiments of the present invention, it is preferable that, on the inner wall surface within the insulating case, the projection provided in the insulating case, or the folded portion or cut-and-raised portion provided on the metal terminal is disposed at one of the locations where the end surfaces and opening side surfaces of the insulating case intersect one another.

In the surface-mount positive temperature coefficient thermistor according to preferred embodiments of the present invention, one of the pair of metal terminals is preferably a tabular terminal and the other is preferably a spring terminal, a projection is preferably provided on the one of the metal terminals, and a recess is preferably provided in a main surface of the positive temperature coefficient thermistor element which is engaged with the projection.

In the surface-mount positive temperature coefficient thermistor according to preferred embodiments of the present invention, preferably, a pair of protuberances to make contact with a main surface of the positive temperature coefficient thermistor element are arranged around the prominence provided on the tabular portion of the one of the metal terminal.

In the surface-mount positive temperature coefficient thermistor according to preferred embodiments of the present invention, each of the pair of metal terminals preferably has a wider portion provided to be in contact with the inner wall surface of the end surface of the insulating case.

Another preferred embodiment of the present invention provides a surface-mount positive temperature coefficient thermistor that includes a plate-shaped positive temperature coefficient thermistor element having electrodes provided on a respective one of the opposing main surfaces thereof, and an insulating case having an inner space with the positive temperature coefficient thermistor element inserted therein, and in which a pair of metal terminals are inserted. The pair of metal terminals are arranged to make electrical contact with the respective main surface electrodes of the positive temperature coefficient thermistor element, and to sandwich therebetween the positive temperature coefficient thermistor element in the inner space of the insulating case. The insulating case includes a pair of main surfaces that are substantially parallel to the opposite main surfaces of the positive temperature coefficient thermistor element disposed in the inner space, a pair of opening side surfaces each having an opening portion that is exposed to the outside, and a pair of end surfaces each having a terminal insertion hole provided therein. One end portion of each of the pair of metal terminals is inserted into the inner space of the insulating case from a respective one of the terminal insertion holes, and the other end of each of the pair of metal terminals extends up to one of the main surfaces along the outer wall surface of the insulating case.

Another preferred embodiment of the present invention provides a method for manufacturing a surface-mount positive temperature coefficient thermistor. This method includes the steps of preparing a plate-shaped positive temperature coefficient thermistor element having electrodes provided on opposing main surfaces thereof, preparing an insulating case that includes an inner space with the positive temperature coefficient thermistor element inserted therein, and which includes a pair of main surfaces that are substantially parallel to the opposite main surfaces of the positive temperature coefficient thermistor element disposed within the inner space, a pair of opening side surfaces each having an opening portion where the inner space is exposed to the outside, and a pair of end surfaces having a terminal insertion hole formed therein, inserting one of the metal terminals into the inner space from the terminal insertion hole located at the lower-side of one of the end surfaces of the insulating case, inserting the positive temperature coefficient thermistor element into the inner space from one of the pair of opening side surfaces of the insulating case, inserting the other of the metal terminals into the inner space from the terminal insertion hole located at the upper-side of the other of the end surfaces, whereby the positive temperature coefficient thermistor element and the pair of metal terminals are brought into pressure contact with each other.

Another preferred embodiment of the present invention provides an insulating case which facilitates insertion of the terminals into the insulating case. Furthermore, by inserting the terminals and thermistor element into the single case in a specific sequence, preferred embodiments of the present invention enable the positive temperature coefficient thermistor element and terminals to be reliably brought into pressure contact with each other, thereby preventing the position of the positive temperature coefficient thermistor element from deviating its desired position. Such an arrangement also offers advantages in imposing no severe strain on the mold structure and improving the mass-productivity when manufacturing the insulating case and metal terminals.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments according to the present invention will be described with reference to the accompanying drawings.

First Preferred Embodiment

Figure 1:
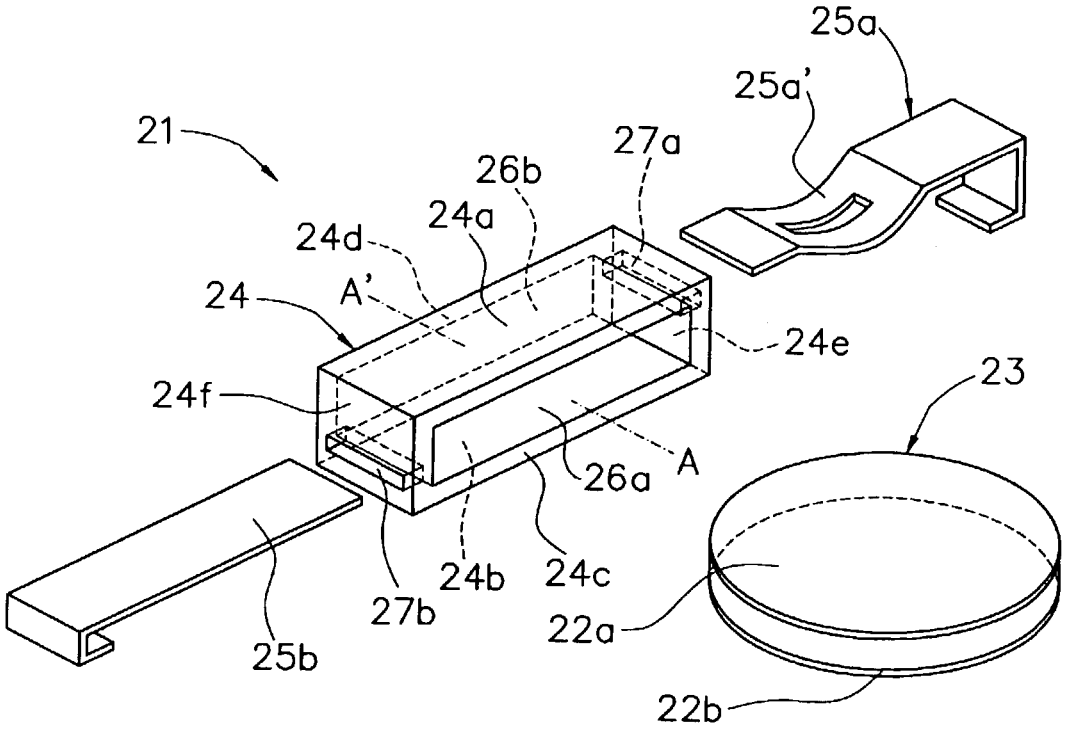
FIG. 1 is a schematic exploded view showing a surface-mount positive temperature coefficient thermistor according to a first preferred embodiment of the present invention.
Figure 2:
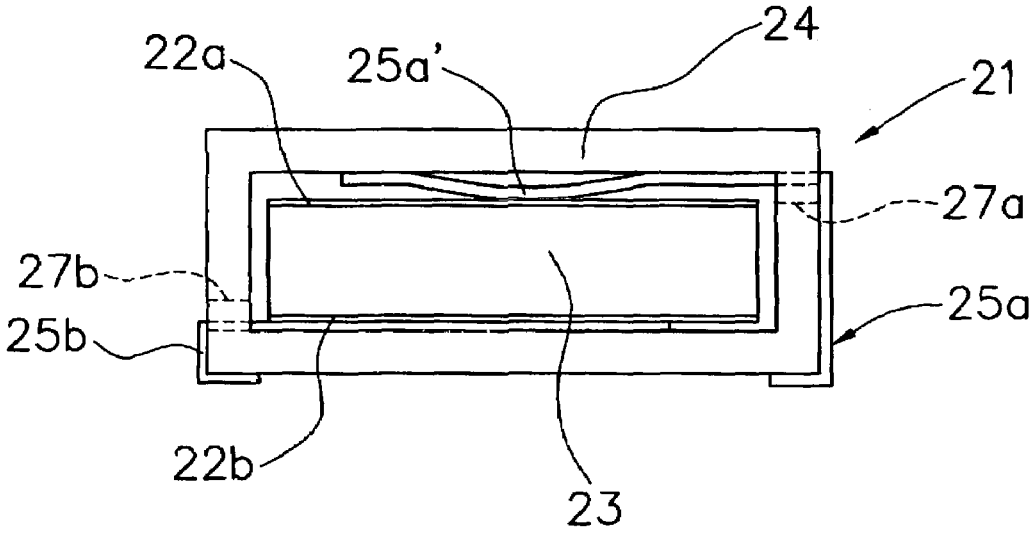
FIG. 2 is a front view illustrating the surface-mount positive temperature coefficient thermistor shown in FIG. 1.

FIG. 1 is a schematic exploded view showing a surface-mount positive temperature coefficient thermistor 21 according to a first preferred embodiment of the present invention, and FIG. 2 is a front view thereof.

The surface-mount positive temperature coefficient thermistor 21 preferably includes a disk-shaped positive temperature coefficient thermistor element 23 having electrodes 22*a* and 22*b* provided on opposing main surfaces thereof, and an insulating case 24 having an inner space with the positive temperature coefficient thermistor element 23 inserted therein, and a pair of metal terminals 25*a* and 25*b* arranged to make electrical contact with the opposite main surface electrodes 22*a* and 22*b* of the positive temperature coefficient thermistor element 23, and to sandwich therebetween the positive temperature coefficient thermistor element 23 within the inner space of the insulating case 24.

The positive temperature coefficient thermistor element 23 is preferably a disk-shaped unit with a diameter of about 8 mm and a thickness of about 2 mm.

The insulating case 24 is made of PPS (polyphenylene sulfide) resin, and is formed into a substantially rectangular configuration having outer dimensions of about 10 mm×about 4 mm×about 4 mm. The insulating case 24 has an inner space with the positive temperature coefficient thermistor element 23 inserted therein, and includes a pair of main surfaces 24*a* and 24*b* opposed to each other; a pair of opening side surfaces 24*c* and 24*d* opposed to each other; and a pair of end surfaces 24*e* and 24*f* opposed to each other.

The pair of opening side surfaces 24*c* and 24*d* of the insulating case 24 have opening portions 26*a* and 26*b* where the inner space is exposed to the outside, the opening portions having dimensions of approximately 8.6 mm×2.6 mm.

The pair of mutually opposed end surfaces 24*e* and 24*f* of the insulating case 24, have terminal insertion holes 27*a* and 27*b*, respectively, each having dimensions of, for example, about 2.4 mm×about 0.5 mm. The terminal insertion holes 27*a* and 27*b* are arranged so as to be rotated with respect to each other by an angle of about 180 degrees about the axis A–A' connecting the centers of the pair of opening side surfaces 24*c* and 24*d* of the insulating case 24.

The metal terminals 25*a* and 25*b* are preferably made of phosphor bronze. The upper-side metal terminal 25*a* and the lower-side metal surface 25*b* have thicknesses of about 0.2 mm and about 0.15 mm, respectively, and a width of about 2.2 mm.

The upper-side metal terminal 25*a* is a spring terminal, and one end portion thereof is disposed along the inner wall surface of one main surface 24*a* of the insulating case, and extends from the terminal insertion hole 27*a* in the upper side of one end surface 24*e* of the insulating case 24 to the vicinity of the inner wall surface of the other end surface 24*f*. A pressing portion 25*a*' having a curved shape is provided on the upper-side metal terminal 25*a*. The other end portion of the upper-side metal terminal 25*a* is led out from the terminal insertion hole 27*a* to the outside of the insulating case 24, and extends to the outer wall surface of the other main surface 24*b* of the insulating case 24 along the outer wall surface of the one end surface 24*e* thereof.

The lower-side metal terminal 25*b* is a tabular terminal, and one end portion thereof is disposed along the inner wall surface of the other main surface 24*b* of the insulating case, and extends from the terminal insertion hole 27*b* in the lower side of the other end surface 24*f* of the insulating case 24 to the vicinity of the inner wall surface of the one end surface 24*e*. The other end portion of the lower-side metal terminal 25*b* is led out from the terminal insertion hole 27*b* to the outside of the insulating case 24, and extends to the outer wall surface of the other main surface 24*b* of the insulating case 24 along the outer wall surface of the other end surface 24*f* thereof.

The surface-mount positive temperature coefficient thermistor 21 is preferably manufactured by the following method. First, the lower-side metal terminal 25*b* is inserted into the insulating case 24 from the terminal insertion hole 27*b* located at the lower side of the other end surface 24*f* of the insulating case 24. Next, the positive temperature coefficient thermistor element 23 is inserted into the inner space of the insulating case 24 through the opening portion 26*a* of the one side surface 24*c* (or the opening portion 26*b* of the other side face 24*d*) of the insulating case 24. Thereafter, the upper-side metal terminal 25*a* is inserted into the insulating case 24 from the terminal insertion hole 27*a* located at the upper side of the one end surface 24*e* of the insulating case 24.

More specifically, the lower-side metal terminal 25*b*, positive temperature coefficient thermistor element 23, and upper-side metal terminal 25*a* are inserted in that order into the inner space of the insulating space 24 from directions that are different by an angle of about 90 degrees from one another. Thereafter, the positive temperature coefficient thermistor element 23 is press-held between the upper and lower metal terminals.

At this time, the electrode 22*a* on the upper main surface of the positive temperature coefficient thermistor element 23 is electrically connected to the pressing portion 25*a*' of the upper-side terminal 25 by a point contact or line contact. On the other hand, the electrode 22*b* on the lower main surface of the positive temperature coefficient thermistor element 23 is electrically connected to the lower-side terminal 25*b* by a surface contact.

According to this surface-mount positive temperature coefficient thermistor 21, the terminal insertion holes 27*a* and 27*b* located at different heights and formed on the opposite end surfaces 24*e* and 24*f*, are arranged so as to be rotated with respect to each other by an angle of about 180 degrees about the axis A–A' connecting the centers of the pair of opening side surfaces 24*c* and 24*d* where the opening portions 26*a* and 26*b* are formed, respectively. Therefore, the orientation of the insulating case 24 is irrelevant when inserting the upper and lower metal terminals 25*a* and 25*b* into the insulating case 24.

Furthermore, it is unnecessary to insert-mold the upper and lower metal terminals 25*a* and 25*b* in the insulating case 24 in advance, thereby facilitating the manufacture of the surface-mount positive temperature coefficient thermistor 21.

Figure 21:
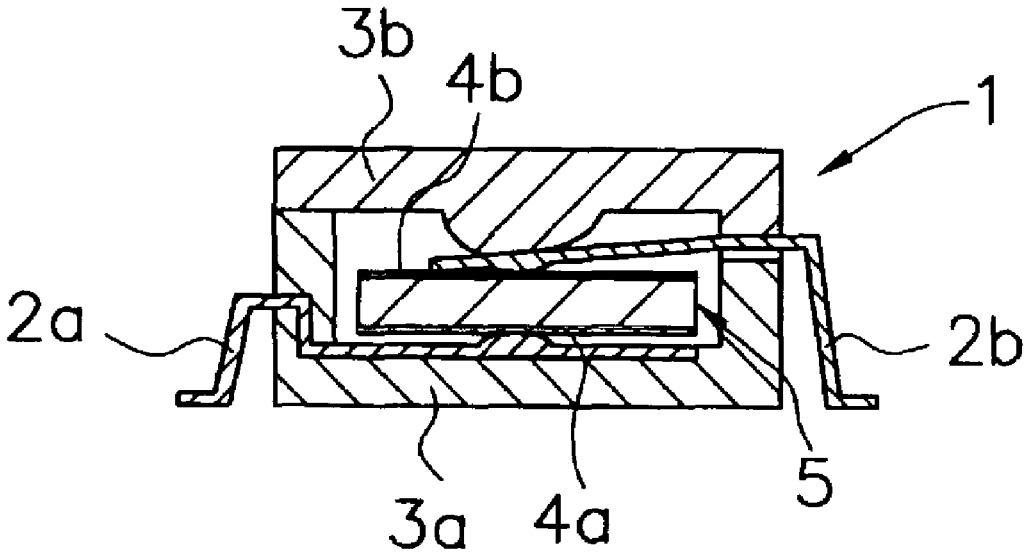
FIG. 21 PRIOR ART
FIG. 21 is a sectional view showing a conventional example of a surface-mount positive temperature coefficient thermistor.
Figure 22:
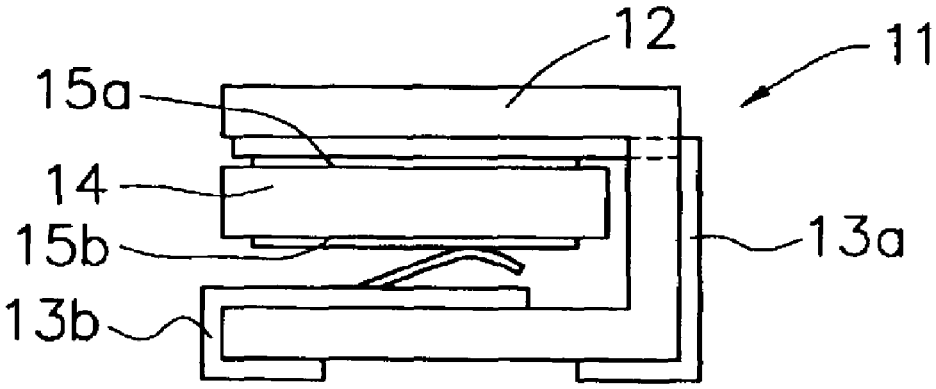
FIG. 22 PRIOR ART
FIG. 22 is a front view showing another conventional example of a surface-mount positive temperature coefficient thermistor.

Moreover, the positive temperature coefficient thermistor element 23 and the upper and lower metal terminals 25*a* and 25*b* can be brought into pressure contact with each other using only the single insulating case 24, thereby eliminating the need to engage a blocking portion and a cover portion, unlike the conventional surface-mount positive temperature coefficient thermistor 1 shown in FIG. 21.

Also, because the terminal insertion holes 27*a* and 27*b* are configured such that the strength of the insulating case 24 is not reduced, the case is sufficiently strong even if the case 24 is as thin as about 0.6 mm to about 0.7 mm.

Second Preferred Embodiment

Figure 3:
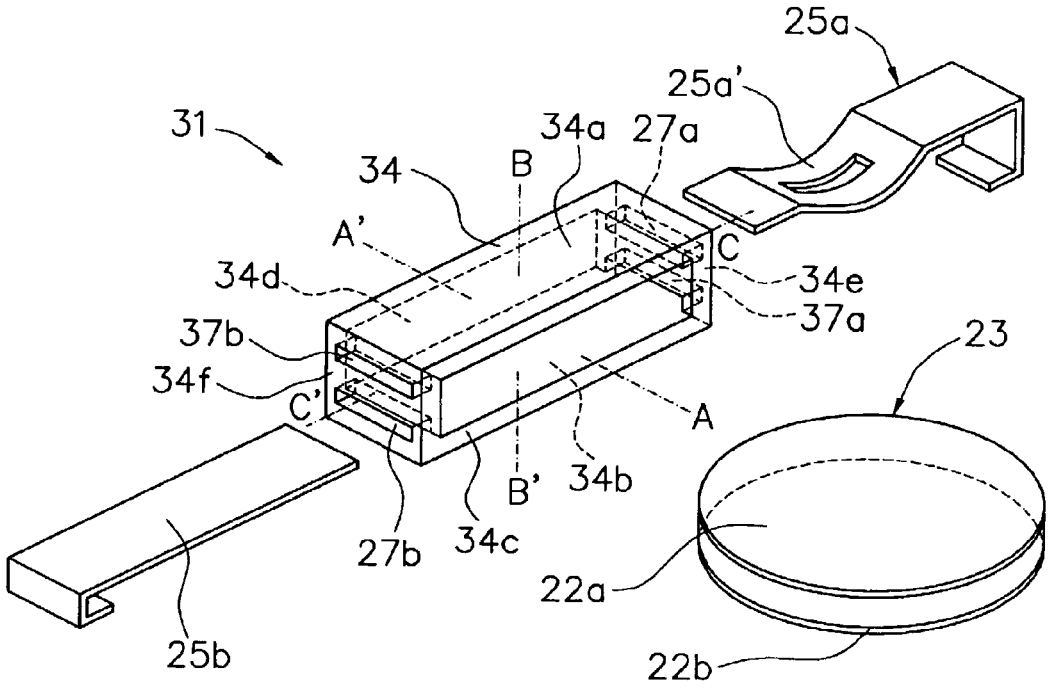
FIG. 3 is a schematic exploded view showing a surface-mount positive temperature coefficient thermistor according to a second preferred embodiment of the present invention.

FIG. 3 is a schematic exploded view showing a surface-mount positive temperature coefficient thermistor 31 according to a second preferred embodiment of the present invention.

Except for the structure of its insulating case 34, the surface-mount positive temperature coefficient thermistor 31 is preferably substantially the same as the surface-mount positive temperature coefficient thermistor 21 according to the first preferred embodiment, and therefore, the same reference numerals are used to denote the same parts and detailed description thereof is omitted.

The insulating case 34 for the surface-mount positive temperature coefficient thermistor 31 includes a group of two terminal insertion holes 27*a* and 37*a* and a group of two terminal insertion holes 27*b* and 37*b* provided in a pair of end surfaces 34*e* and 34*f* opposing to each other. The terminal insertion holes 27*a* and 37*a* and the terminal insertion holes 27*b* and 37*b* are arranged such that one of the two groups is rotated with respect to the other of the two groups, by an angle of about 180 degrees about the axis B–B' connecting the centers of the pair of main surfaces 34*a* and 34*b* of the insulating case 34, the axis A–A' connecting the centers of the pair of opening side surfaces 34*c* and 34*d* thereof, and the axis C–C' connecting the centers of the pair of end surfaces 34*e* and 34*f* thereof.

According to this surface-mount positive temperature coefficient thermistor 31, since the group of terminal insertion holes 27*a* and 37*a* and the group of terminal insertion holes 27*b* and 37*b*, which are respectively formed in the opposite end surfaces 34*e* and 34*f* of the case 34, are arranged such that one of these two groups is rotated with respect to the other of the two groups by an angle of about 180 degrees about the axes each connecting the centers of the opposite main surfaces, opposite opening side surfaces, and opposite end faces of the insulating case 34 having a substantially rectangular shape, the orientation of the insulating case 34 is irrelevant when inserting the upper and lower metal terminals 25*a* and 25*b* into the insulating case 34. This improves the working efficiency over that of the first preferred embodiment.

Third Preferred Embodiment

Figure 4:
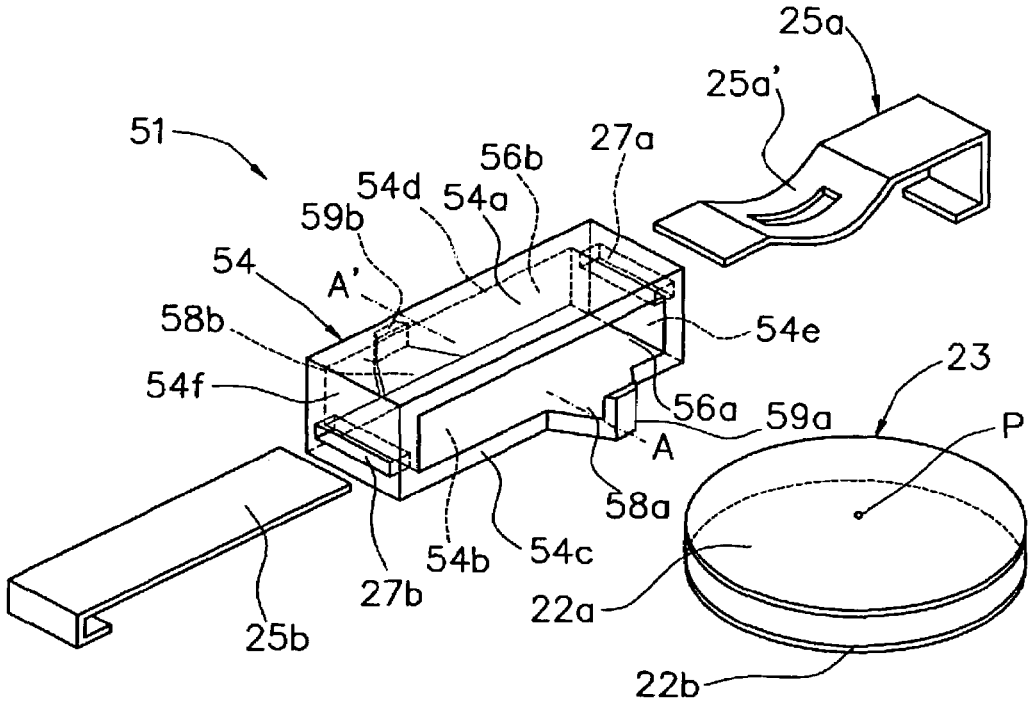
FIG. 4 is a schematic exploded view showing a surface-mount positive temperature coefficient thermistor according to a third preferred embodiment of the present invention.
Figure 5:
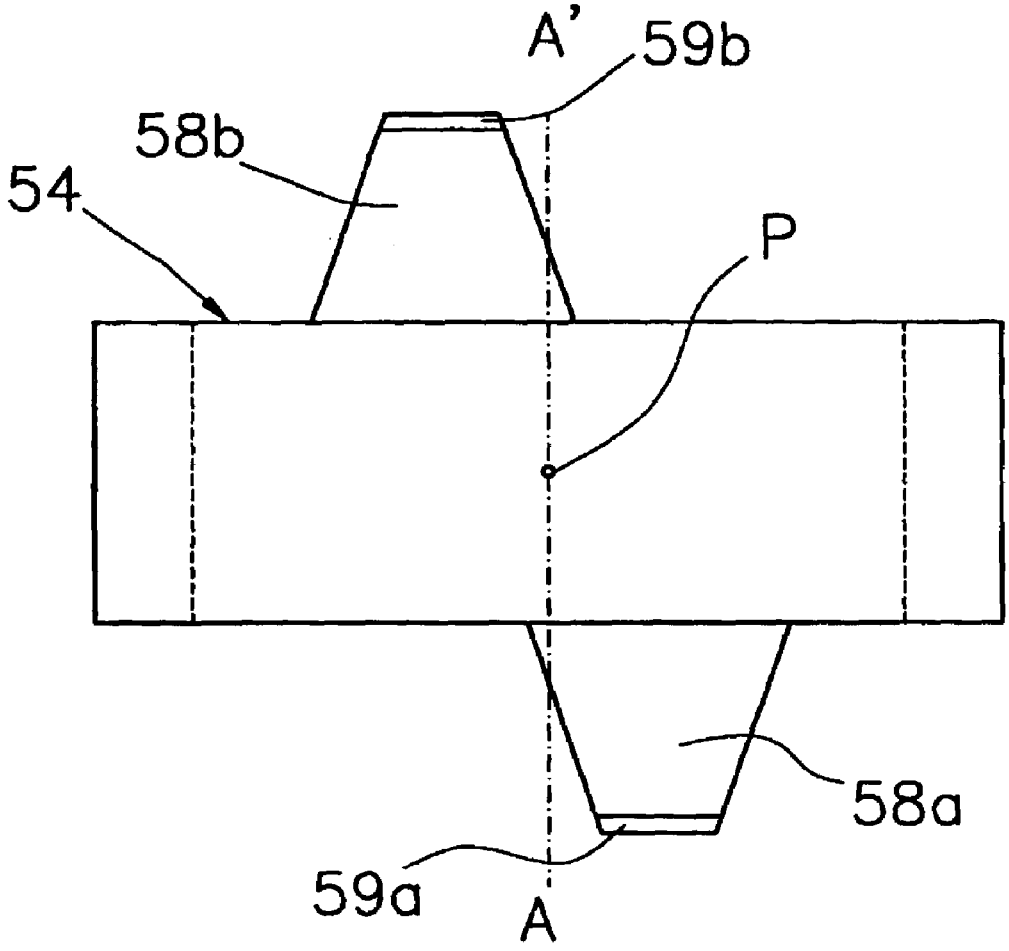
FIG. 5 is a plan view illustrating an insulating case for the surface-mount positive temperature coefficient thermistor shown in FIG. 4.

FIG. 4 is a schematic exploded view showing a surface-mount positive temperature coefficient thermistor 51 according to a third preferred embodiment of the present invention. FIG. 5 is a plan view illustrating an insulating case 54 for the surface-mount positive temperature coefficient thermistor 51.

Except for the structure of the insulating case 54, the surface-mount positive temperature coefficient thermistor 51 is preferably substantially the same as the surface-mount positive temperature coefficient thermistor 21 according to the first preferred embodiment, and therefore, the same reference numerals are used to denote the same parts and detailed description thereof is omitted.

The insulating case 54 of the surface-mount positive temperature coefficient thermistor 51 includes an extension portion 58*a* extending from one main surface 54*b* toward the side of an opening side surface 54*c*, and an extension portion 58*b* extending from the one main surface 54*b* toward the side of an opening side surface 54*d*. Protrusions 59*a* and 59*b* are provided on the front ends of the extension portions 58*a* and 58*b*, respectively. The protrusions 59*a* and 59*b* are arranged so as to be point-symmetrical with respect to the center P of the positive temperature coefficient thermistor element 23 inserted in the inner space of the insulating case 54, as in the case of the first preferred embodiment.

Terminal insertion holes 27*a* and 27*b*, respectively, are provided in opposed end surfaces 54*e* and 54*f* of the insulating case 54. The terminal insertion holes 27*a* and 27*b* are arranged to be rotated with respect to each other by an angle of about 180 degrees about the axis A–A' connecting the centers of the pair of opening side surfaces 54*c* and 54*d* of the insulating case 54.

According to this surface-mount positive temperature coefficient thermistor 51, the pair of protrusions 59*a* and 59*b* of the insulating case 54 define locking portions by making contact with the side surface of the positive temperature coefficient thermistor element 23, thereby preventing the position of the positive temperature coefficient thermistor element 23 from deviating.

The arrangements of the insulating case 54 are not limited to the above-described ones. For example, as in the case of the insulating case 34 in the second preferred embodiment, an insulating case having terminal insertion holes provided in two portions in a pair of opposed end surfaces may be used.

Fourth Preferred Embodiment

Figure 6:
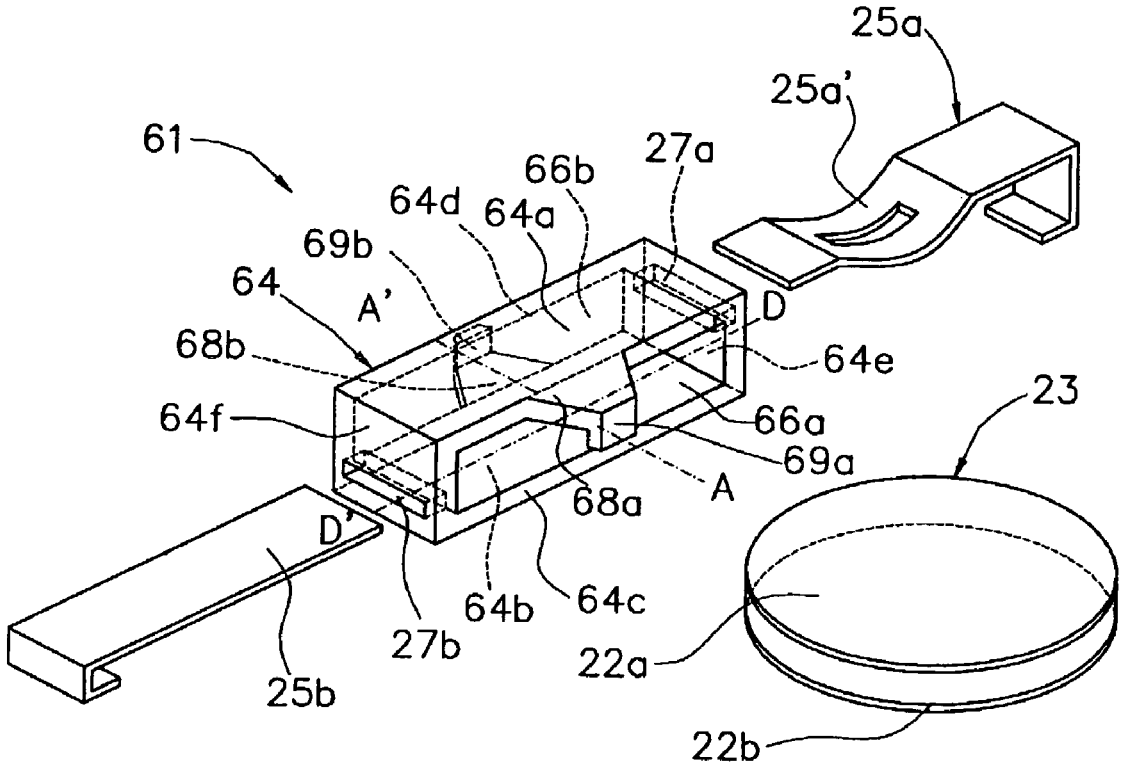
FIG. 6 is a schematic exploded view showing a surface-mount positive temperature coefficient thermistor according to a fourth preferred embodiment of the present invention.
Figure 7:
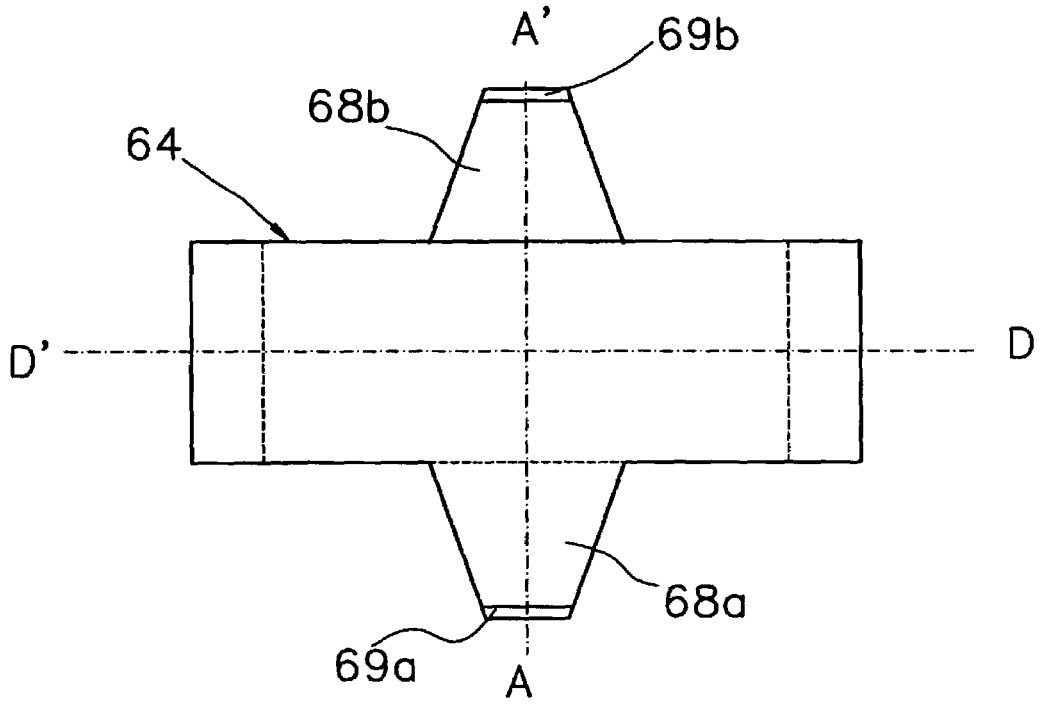
FIG. 7 is a plan view illustrating an insulating case for the surface-mount positive temperature coefficient thermistor shown in FIG. 6.

FIG. 6 is a schematic exploded view showing a surface-mount positive temperature coefficient thermistor 61 according to a fourth preferred embodiment of the present invention. FIG. 7 is a plan view illustrating an insulating case 64 for the surface-mount positive temperature coefficient thermistor 61.

Except for the structure of its insulating case 64, the surface-mount positive temperature coefficient thermistor 61 is the same as the surface-mount positive temperature coefficient thermistor 21 according to the first preferred embodiment, and therefore, the same reference numerals are used to denote the same parts and detailed description thereof is omitted.

The insulating case 64 for the surface-mount positive temperature coefficient thermistor 61 includes an extension portion 68*a* extending from one main surface 64*a* toward the side of an opening side surface 64*c*, and an extension portion 68*b* extending from the other main surface 64*b* toward the side of an opening side surface 64*d*. Protrusions 69*a* and 69*b* are provided on the front ends of the extension portions 68*a* and 68*b*, respectively. The protrusions 69*a* and 69*b* are arranged so as to be line-symmetrical with respect to the center line (D–D') passing through one end face 64*e* of the insulating case 64, the center P of the positive temperature coefficient thermistor element 23, and the other the end surface 64*f* of the insulating case 64.

Terminal insertion holes 27*a* and 27*b* are provided in the pair of opposed end surfaces 64*e* of the insulating case 64. The terminal insertion holes 27*a* and 27*b* are arranged so as to be rotated with respect to each other by an angle of about 180 degrees about the axis A–A' connecting the centers of a pair of opening side surfaces 64*c* and 64*d* of the insulating case 64.

According to this surface-mount positive temperature coefficient thermistor 61, since the pair of protrusions 69*a* and 69*b* of the insulating case 64 define locking portions by making contact with the side surface of the positive temperature coefficient thermistor element 23, the position of the positive temperature coefficient thermistor element 23 is prevented from deviating.

The arrangements of the insulating case 64 are not limited to the above-described ones. For example, as in the case of the insulating case 34 in the second preferred embodiment, an insulating case having terminal insertion holes provided in two portions in a pair of opposed end surfaces may be used.

Fifth Preferred Embodiment

Figure 8:
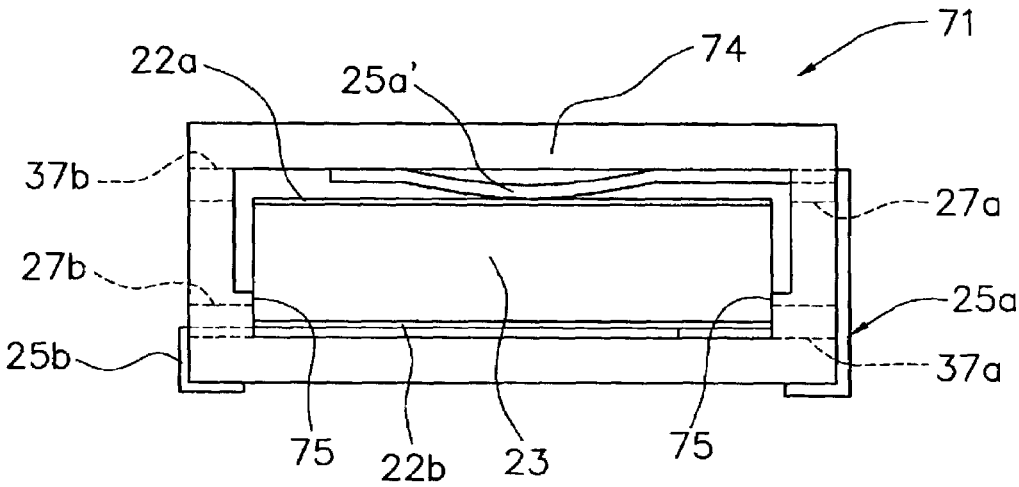
FIG. 8 is a front view showing a surface-mount positive temperature coefficient thermistor according to a fifth preferred embodiment of the present invention.
Figure 9:
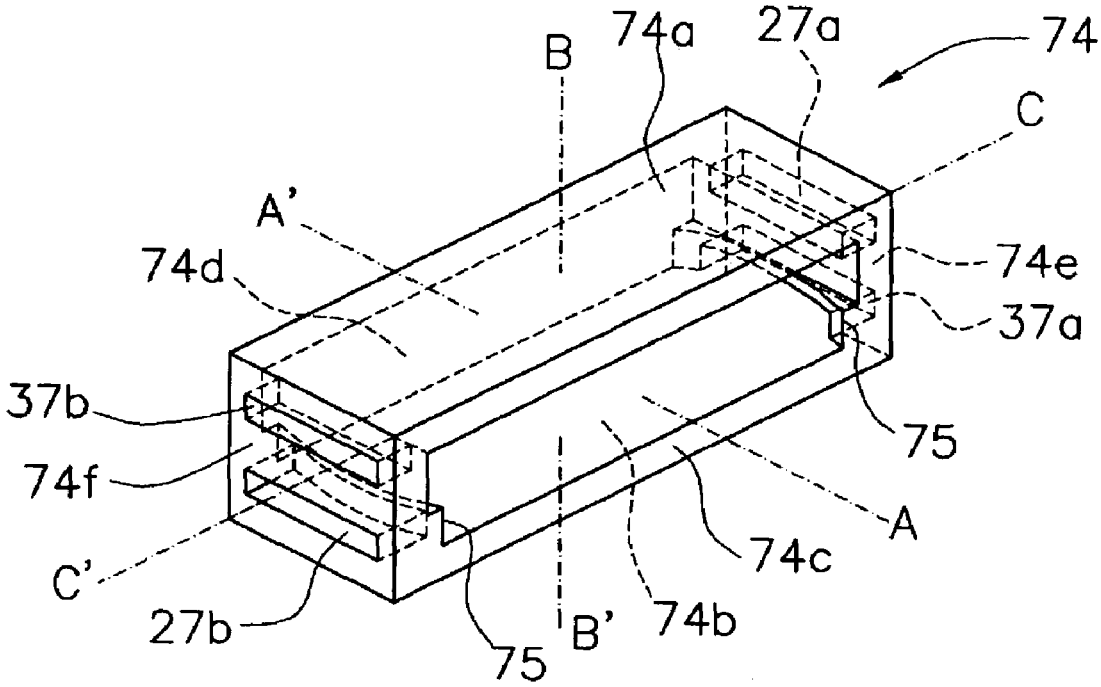
FIG. 9 is a schematic view illustrating an insulating case for the surface-mount positive temperature coefficient thermistor shown in FIG. 8.

FIG. 8 is a front view showing a surface-mount positive temperature coefficient thermistor 71 according to a fifth preferred embodiment of the present invention. FIG. 9 is a schematic view illustrating an insulating case 74 for the surface-mount positive temperature coefficient thermistor 71.

Except for the structure of its insulating case 74, the surface-mount positive temperature coefficient thermistor 71 is preferably substantially the same as the surface-mount positive temperature coefficient thermistor 31 according to the second preferred embodiment, and therefore, the same reference numerals are used to denote the same parts and detailed description thereof is omitted.

The insulating case 74 for the surface-mount positive temperature coefficient thermistor 71 includes locking portions 75 therein. The locking portions 75 are provided on the inner wall surface of a main surface 74*b* of the insulating case 74. More specifically, the locking portions 75 are arranged on the inner wall surface of the main surface 74*b* of the insulating case 74, and that intersect a pair of opposing end surfaces 74*e* and 74*f* of the insulating case. The locking portions 75 are integrally molded with the insulating case 74.

The locking portion 75 function to position the positive temperature coefficient thermistor element 23 by making contact with the side surface of the positive temperature coefficient thermistor element 23 inserted in the inner space of the insulating case 74, as in the case of the first preferred embodiment. It is, therefore, necessary to configure the locking portions so as to fix the positive temperature coefficient thermistor element 23.

A group of two terminal insertion holes 27*a* and 37*a* and a group of two terminal insertion holes 27*b* and 37*b* are provided in a pair of opposed end surfaces 74*e* and 74*f*. The group of terminal insertion holes 27*a* and 37*a* and that of terminal insertion holes 27*b* and 37*b* are arranged such that one of these two groups is rotated with respect to the other of the two groups by an angle of about 180 degrees about the axis B–B' connecting the centers of a pair of main surfaces 74*a* and 74*b*, the axis A–A' connecting the centers of a pair of opening side surfaces 74*c* and 74*d*, and the axis C–C' connecting the centers of the pair of end surfaces 74*e* and 74*f* of the insulating case 74.

In this surface-mount positive temperature coefficient thermistor 71, the locking portion 75 makes contact with the side surface of the positive temperature coefficient thermistor element 23, thereby preventing positional deviation of the positive temperature coefficient thermistor element 23.

The arrangements of the insulating case 74 are not limited to the above-described ones. For example, as in the case of the insulating case 24 in the first preferred embodiment, an insulating case having terminal insertion holes formed in ones in a pair of opposed end surfaces may be used.

Sixth Preferred Embodiment

Figure 10:
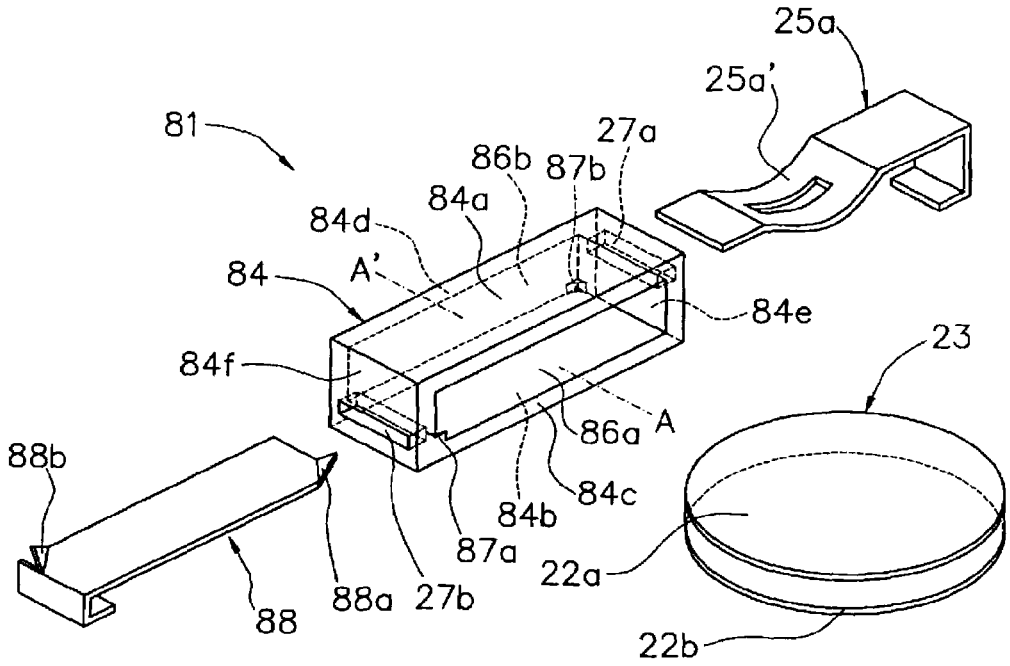
FIG. 10 is a schematic exploded view showing a surface-mount positive temperature coefficient thermistor according to a sixth preferred embodiment of the present invention.

FIG. 10 is a schematic exploded view showing a surface-mount positive temperature coefficient thermistor 81 according to a sixth preferred embodiment of the present invention.

Except for the structures of the insulating case 84 and metal terminal 88, the surface-mount positive temperature coefficient thermistor 81 is the same as the surface-mount positive temperature coefficient thermistor 21 according to the first preferred embodiment, and therefore, the same reference numerals are used to denote the same parts and detailed description thereof is omitted.

On the inner wall surface of a main surface 84*b* of the insulating case 84 for the surface-mount positive temperature coefficient thermistor 81, the insulating case 84 includes a locking portion 87*b* provided at the corner where one end surface 84*e* and one opening side surface 84*d* cross each other, and a locking portion 87*a* provided at the corner where the other end surface 84*f* and the other opening side surface 84*c* cross each other. The locking portions 87*a* and 87*b* are integrally molded with the insulating case 84. The locking portions 87*a* and 87*b* make contact with the side surface of the positive temperature coefficient thermistor element 23, thereby performing a function of preventing positional deviation of the positive temperature coefficient thermistor element 23.

Terminal insertion holes 27*a* and 27*b* are provided in a pair of opposed end surfaces 84*e* and 84*f* of the insulating case 84. The terminal insertion holes 27*a* and 27*b* are arranged so as to be rotated with respect to each other by an angle of about 180 degrees about the axis A–A' connecting the centers of a pair of opening side surfaces 84*c* and 84*d* of the insulating case 84.

On the other hand, the metal terminal 88 for the surface-mount positive temperature coefficient thermistor 81 includes locking portions 88*a* and 88*b* provided at corners thereof. The locking portions 88*a* and 88*b* are provided at locations on opposite sides of the locations where the locking portions 87*a* and 87*b* are provided in the insulating case 84. The locking portions 88*a* and 88*b* prevents positional deviation of the positive temperature coefficient thermistor element 23 by making contact with the side surface thereof. The locking portion 88*a* is a folded portion formed by folding a corner of the metal terminal 88. The locking portion 88*b* is a cut-and-raised portion formed by cutting and raising a corner of the metal terminal 88.

In this surface-mount positive temperature coefficient thermistor 81, the locking portions 87*a* and 87*b* provided in the insulating case 84, and the locking portions 88*a* and 88*b* provided on the metal terminal 88, make contact with the side surface of the positive temperature coefficient thermistor element 23, thereby preventing positional deviation of the positive temperature coefficient thermistor element 23.

The arrangements of the insulating case 84 are not limited to the arrangements described above. For example, as in the case of the insulating case 34 in the second preferred embodiment, an insulating case having terminal insertion holes provided in two portions in a pair of opposed end surfaces may be used.

Seventh Preferred Embodiment

Figure 11:
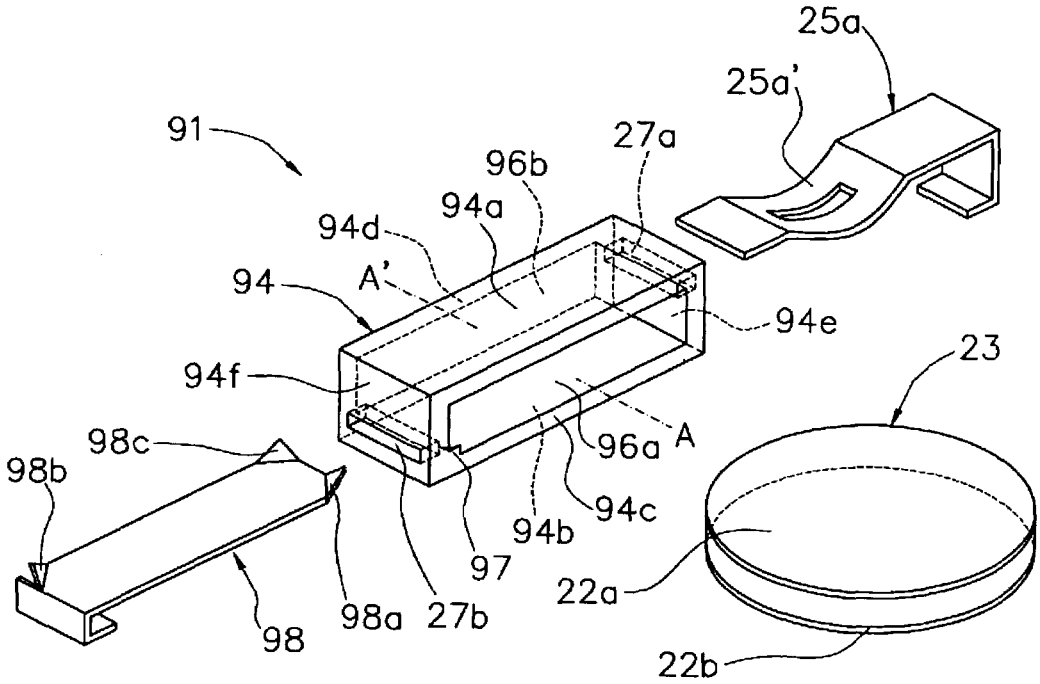
FIG. 11 is a schematic exploded view showing a surface-mount positive temperature coefficient thermistor according to a seventh preferred embodiment of the present invention.

FIG. 11 is a schematic exploded view showing a surface-mount positive temperature coefficient thermistor 91 according to a second preferred embodiment of the present invention.

Except for the structures of the insulating case 94 and metal terminal 98, the surface-mount positive temperature coefficient thermistor 91 is preferably substantially the same as the surface-mount positive temperature coefficient thermistor 21 according to the first preferred embodiment, and therefore, the same reference numerals are used to denote the same parts and detailed description thereof is omitted.

On the inner wall surface of a main surface 94*b* of the insulating case 94 for the surface-mount positive temperature coefficient thermistor 91, the insulating case 94 includes a locking portion 97 provided at the corner where one end surface 94*f* and one opening side surface 94*c* cross each other. The locking portion 97 is integrally molded with the insulating case 94. The locking portion 97 prevents positional deviation of the positive temperature coefficient thermistor element 23 by making contact with the side surface thereof.

Terminal insertion holes 27*a* and 27*b* are provided in a pair of opposed end surfaces 94*e* and 94*f* of the insulating case 94. The terminal insertion holes 27*a* and 27*b* are arranged so as to be rotated with respect to each other by an angle of about 180 degrees about the axis A–A' connecting the centers of a pair of opening side surfaces 94*c* and 94*d* of the insulating case 94.

On the other hand, the metal terminal 98 of the surface-mount positive temperature coefficient thermistor 91 include locking portions 98*a*, 98*b*, and 98*c* provided at corners thereof. The locking portions 98*a*, 98*b*, and 98*c* are provided at locations other than the location where the locking portion 97 is provided in the insulating case 94. The locking portions 98*a*, 98*b*, and 98*c* make contact with the side surface of the positive temperature coefficient thermistor element 23, thereby preventing positional deviation of the positive temperature coefficient thermistor element 23. The locking portions 98*a* and 98*c* are folded portions formed by folding a corner of the metal terminal 98. The locking portion 98*b* is a cut-and-raised portion formed by cutting and raising a corner of the metal terminal 98.

In this surface-mount positive temperature coefficient thermistor 91, the locking portion 97 provided in the insulating case 94, and the locking portions 98*a*, 98*b*, and 98*c* provided on the metal terminal 98 prevent positional deviation of the positive temperature coefficient thermistor element 23 by making contact with the side surface thereof.

The arrangements of the insulating case 94 are not limited to the arrangements described above. For example, as in the case of the insulating case 34 in the second preferred embodiment, an insulating case having terminal insertion holes formed in two portions in a pair of opposed end surfaces may be used.

Eighth Preferred Embodiment

Figure 12:
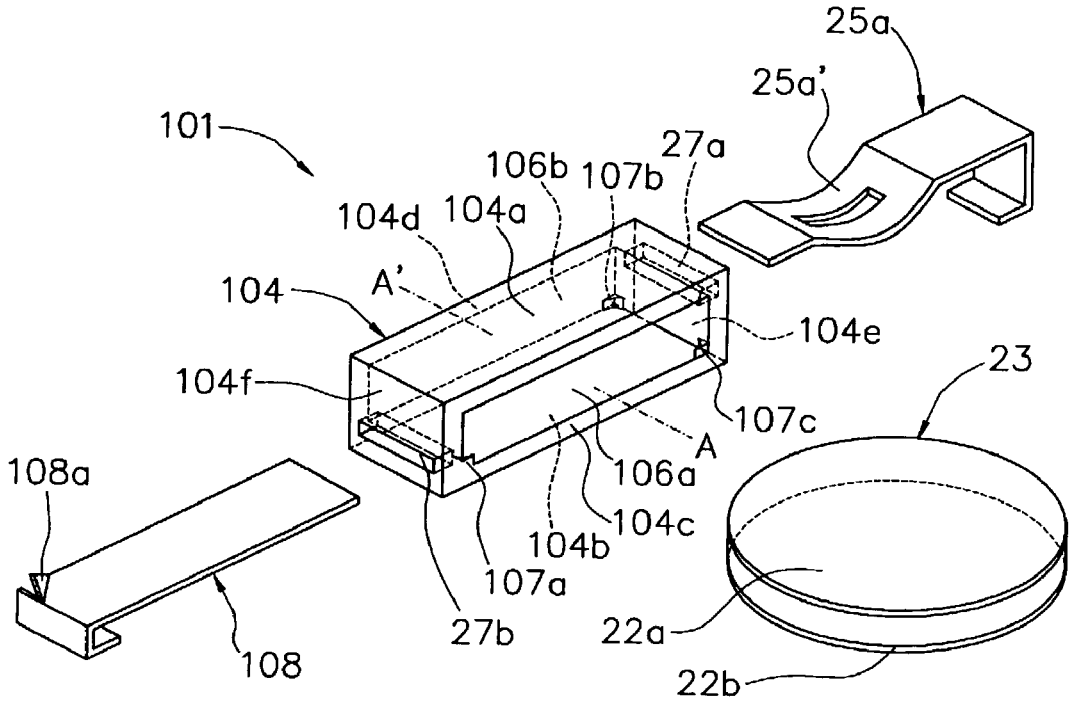
FIG. 12 is a schematic exploded view showing a surface-mount positive temperature coefficient thermistor according to an eighth preferred embodiment of the present invention.

FIG. 12 is a schematic exploded view showing a surface-mount positive temperature coefficient thermistor 101 according to an eighth preferred embodiment of the present invention.

Except for the structures of its insulating case 104 and metal terminal 108, the surface-mount positive temperature coefficient thermistor 101 is preferably substantially the same as the surface-mount positive temperature coefficient thermistor 21 according to the first preferred embodiment, and therefore, the same reference numerals are used to denote the same parts and detailed description thereof is omitted.

On the inner wall surface of a main surface 104*b* of the insulating case 104 for the surface-mount positive temperature coefficient thermistor 101, the insulating case 104 includes a locking portion 107*b* provided at the corner where one end surface 104*e* and one opening side surface 104*d* cross each other, a locking portion 107*a* provided at the corner where the other end surface 104*f* and the other opening side surface 104*c* cross each other, and a locking portion 107*c* provided at the corner where the one end surface 104*e* and the other opening side surface 104*c* cross each other. The locking portions 107*a*, 107*b*, and 107*c* are integrally molded with the insulating case 104. The locking portions 107*a*, 107*b*, and 107*c* prevents positional deviation of the positive temperature coefficient thermistor element 23 by making contact with the side surface thereof.

Terminal insertion holes 27*a* and 27*b* are provided in a pair of opposed end surfaces 104*e* and 104*f* of the insulating case 104. The terminal insertion holes 27*a* and 27*b* are arranged so as to be rotated with respect to each other by an angle of about 180 degrees about the axis A–A' connecting the centers of a pair of opening side surfaces 104*c* and 104*d* of the insulating case 104.

On the other hand, the metal terminal 108 of the surface-mount positive temperature coefficient thermistor 101 includes locking portion 108*a* provided at a corner thereof. The locking portion 108*a* is provided at a position other than the positions where the locking portions 107*a*, 107*b*, and 107*c* are provided in the insulating case 104. The locking portion 108*a* makes contact with the side surface of the positive temperature coefficient thermistor element 23, thereby preventing positional deviation of the positive temperature coefficient thermistor element 23. The locking portion 108*a* is a cut-and-raised portion formed by cutting and raising the corner of the metal terminal 108.

In this surface-mount positive temperature coefficient thermistor 101, the locking portions 107*a*, 107*b*, and 107*c* provided in the insulating case 104, and the locking portion 108*a* provided on the metal terminal 108, prevent positional deviation of the positive temperature coefficient thermistor element 23 by making contact with the side surface thereof.

The arrangements of the insulating case 104 are not limited to the arrangements described above. For example, as in the case of the insulating case 34 in the second preferred embodiment, an insulating case having terminal insertion holes provided in two portions in a pair of opposed end surfaces may be used.

Ninth Preferred Embodiment

Figure 13:
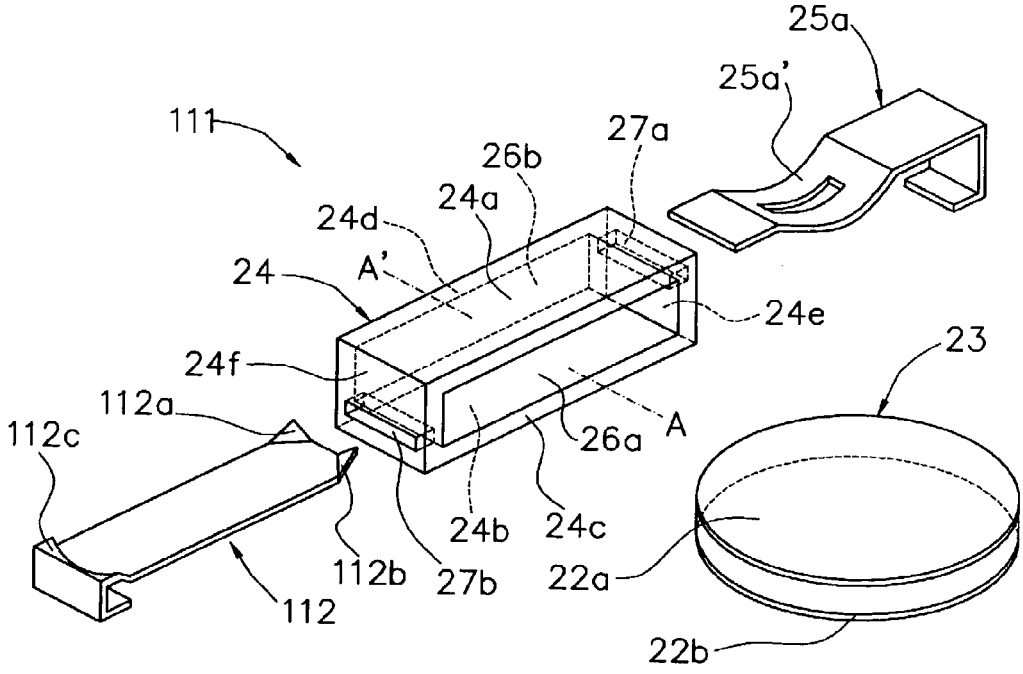
FIG. 13 is a schematic exploded view showing a surface-mount positive temperature coefficient thermistor according to a ninth preferred embodiment of the present invention.

FIG. 13 is a schematic exploded view showing a surface-mount positive temperature coefficient thermistor 111 according to a ninth preferred embodiment of the present invention.

Except for the structure of the metal terminal 112, the surface-mount positive temperature coefficient thermistor 111 is preferably substantially the same as the surface-mount positive temperature coefficient thermistor 21 according to the first preferred embodiment, and therefore, the same reference numerals are used to denote the same parts and detailed description thereof is omitted.

The metal terminal 112 of the surface-mount positive temperature coefficient thermistor 111 includes locking portions 112*a* and 112*b* provided at the two corners on one end surface in the longitudinal direction thereof, and a locking portion 112*c* provided on the other end surface in the longitudinal direction thereof. The locking portions 112*a*, 112*b* and 112*c* make contact with the side surface of the positive temperature coefficient thermistor element 23, thereby preventing positional deviation of the positive temperature coefficient thermistor element 23.

The locking portions 112*a* and 112*b* are folded portions formed by folding corners of the metal terminal 112. The locking portions 112*c* is preferably formed by mold-protruding the metal terminal 112.

In this surface-mount positive temperature coefficient thermistor 111, the locking portions 112*a*, 112*b*, and 112*c* provided on the metal terminal 112 make contact with the side surface of the positive temperature coefficient thermistor element 23, thereby preventing positional deviation of the positive temperature coefficient thermistor element 23.

The arrangements of the insulating case 24 are not limited to the arrangements described above. For example, as in the case of the insulating case 34 in the second preferred embodiment, an insulating case having terminal insertion holes formed in two portions in a pair of opposed end surfaces may be used.

Tenth Preferred Embodiment

Figure 14:
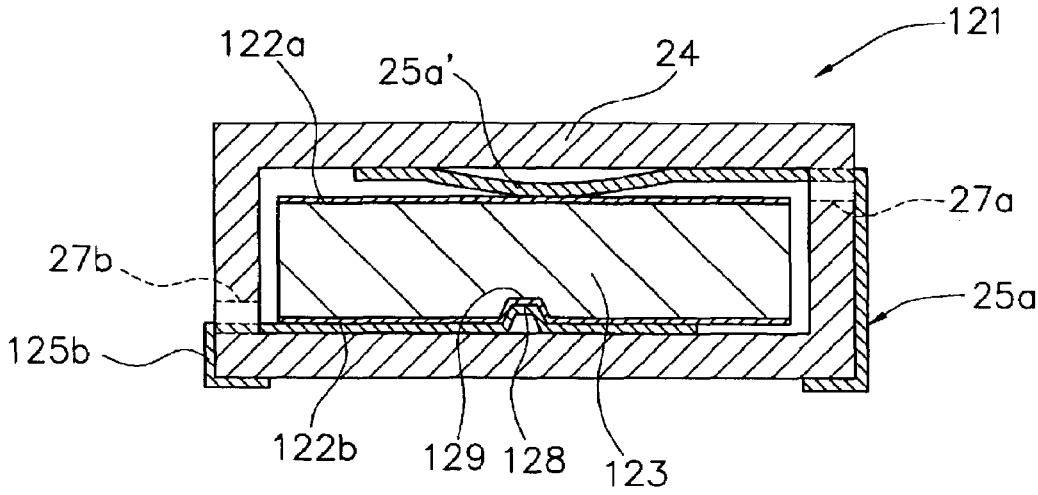
FIG. 14 is a sectional view showing a surface-mount positive temperature coefficient thermistor according to a tenth preferred embodiment of the present invention.
Figure 15A:
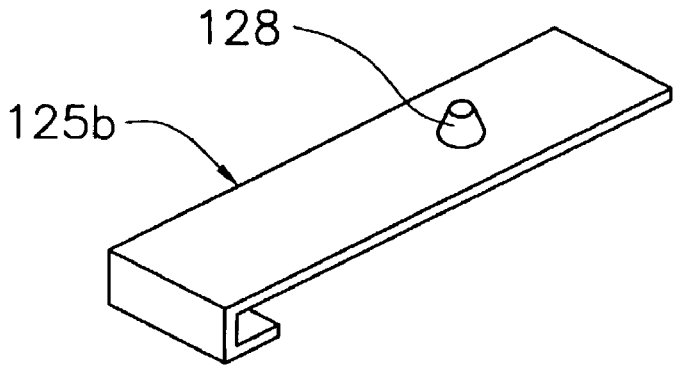
FIGS. 15A and 15B are schematic views showing a lower-side metal terminal and a positive temperature coefficient thermistor element, respectively, used for the surface-mount positive temperature coefficient thermistor shown in FIG. 14.
Figure 15B:
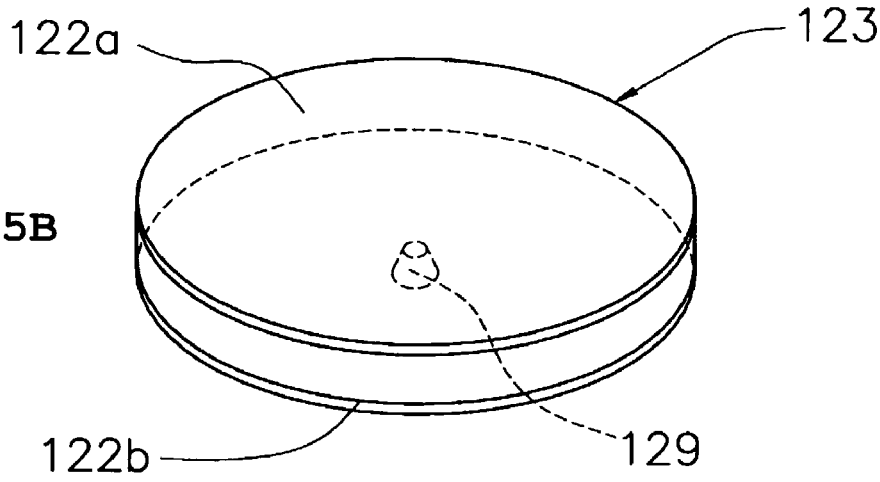

FIG. 14 is a sectional view showing a surface-mount positive temperature coefficient thermistor 121 according to a tenth preferred embodiment of the present invention. FIGS. 15A and 15B are schematic views showing a lower-side metal terminal 125*b* and a positive temperature coefficient thermistor element 123, respectively, used for the surface-mount positive temperature coefficient thermistor 121.

Except for the lower-side metal terminal 125*b* and positive temperature coefficient thermistor element 123, the surface-mount positive temperature coefficient thermistor 121 is preferably substantially the same as the surface-mount positive temperature coefficient thermistor 21 according to the first preferred embodiment, and therefore, the same reference numerals are used to denote the same parts and detailed description thereof is omitted.

The lower-side metal terminal 125*b* of the surface-mount positive temperature coefficient thermistor 121 is a tabular terminal having a projection 128 provided on the tabular portion thereof.

The positive temperature coefficient thermistor element 123 for the surface-mount positive temperature coefficient thermistor 121 includes a recess 129 provided in one main surface thereof. The recess 129 is engaged with the projection 128 on the lower-side metal terminal 125*b*.

In the surface-mount positive temperature coefficient thermistor 121, since the projection 128 on the lower-side metal terminal 125*b* and the recess 129 of the positive temperature coefficient thermistor element 123 are engaged with each other, positional deviation of the positive temperature coefficient thermistor element 123 is prevented when subjected to vibrations or shocks.

Here, as an insulating case 24, the insulating case 34 in the second preferred embodiment may also be used.

Figure 16:
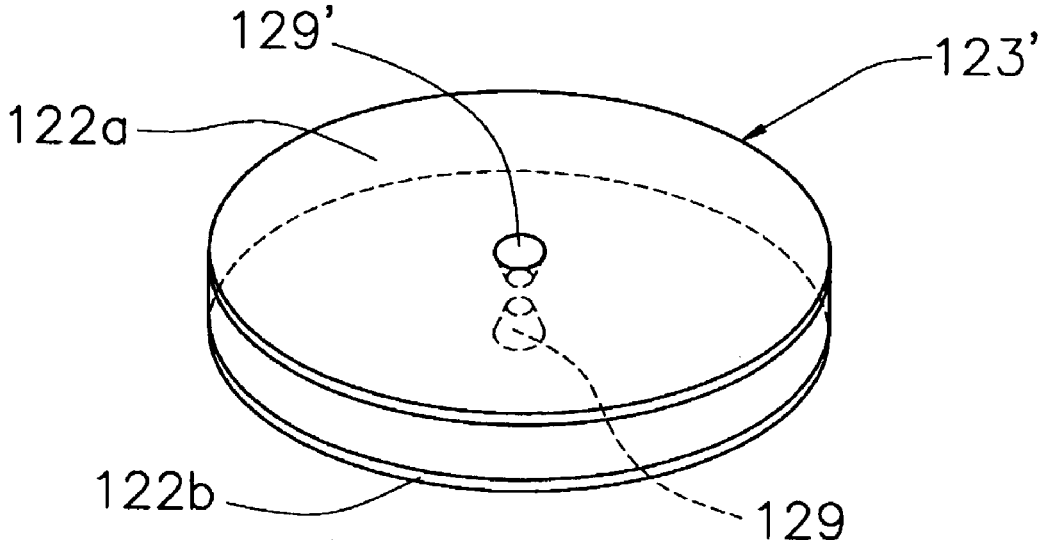
FIG. 16 is a schematic view showing a modification of the positive temperature coefficient thermistor element shown in FIG. 15B.

FIG. 16 is a schematic view showing a positive temperature coefficient thermistor element 123' as a modification of the positive temperature coefficient thermistor element 123. The positive temperature coefficient thermistor element 123' includes recesses 129 and 129' provided on respective opposite main surfaces thereof. The use of this positive temperature coefficient thermistor element 123' eliminates the need to take the posture of the positive temperature coefficient thermistor element 123' itself into consideration when inserting it into the insulating case 24, thereby improving the working efficiency.

Eleventh Preferred Embodiment

Figure 17:
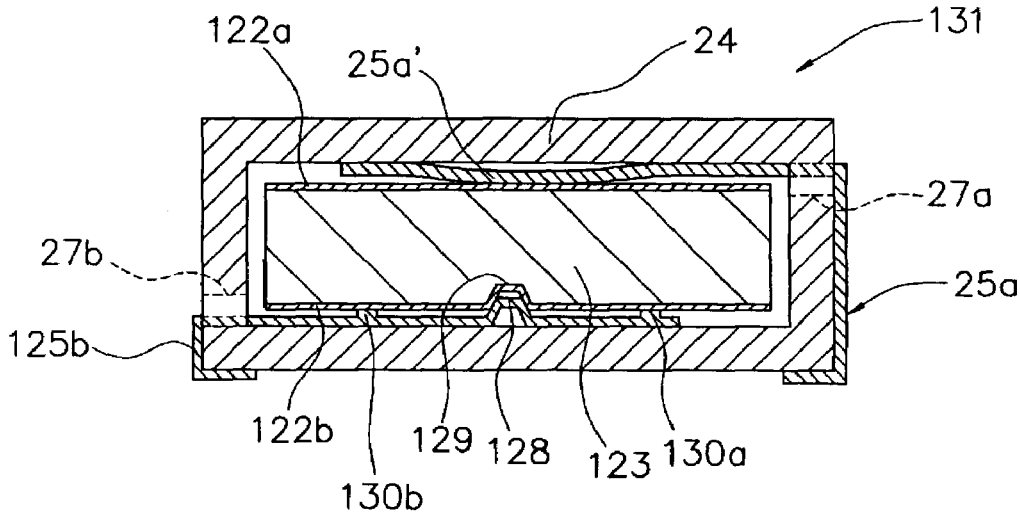
FIG. 17 is a sectional view showing a surface-mount positive temperature coefficient thermistor according to an eleventh preferred embodiment of the present invention.
Figure 18:
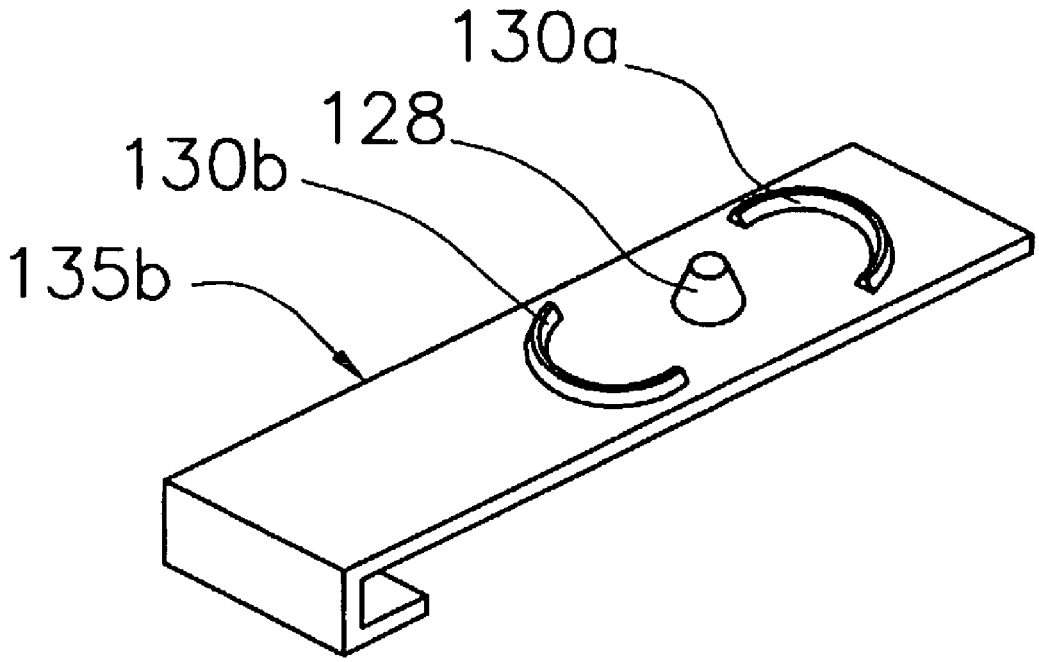
FIG. 18 is a schematic view showing a lower-side metal terminal for the surface-mount positive temperature coefficient thermistor shown in FIG. 17.

FIG. 17 is a sectional view showing a surface-mount positive temperature coefficient thermistor 131 according to a eleventh preferred embodiment of the present invention. FIG. 18 is a schematic view showing a lower-side metal terminal 135*b* for the surface-mount positive temperature coefficient thermistor 131.

Except for the lower-side metal terminal 135*b*, the surface-mount positive temperature coefficient thermistor 131 is preferably substantially the same as the surface-mount positive temperature coefficient thermistor 21 according to the first preferred embodiment, and therefore, the same reference numerals are used to denote the same parts and detailed description thereof is omitted.

The lower-side metal terminal 135*b* for the surface-mount positive temperature coefficient thermistor 131 is a tabular terminal. The lower-side metal terminal 135*b* includes a projection 128 provided on the tabular portion thereof, and a pair of protuberances 130*a* and 130*b* are provided in a half circle-like shape so as to surround the projection 128. The protuberances 130*a* and 130*b* make contact with one main surface of the positive temperature coefficient thermistor element 123. Here, the height of the protuberances 130*a* and 130*b* is less than that of the projection 128.

In the surface-mount positive temperature coefficient thermistor 131, since the protuberances 130*a* and 130*b* on the lower-side metal terminal are brought into contact with the one main surface of the positive temperature coefficient thermistor element 123, the electrical connection between the lower-side metal terminal 135*b*, and the electrodes 122*b* on the one main surface of the positive temperature coefficient thermistor element 123 are reliably established.

Figure 19:
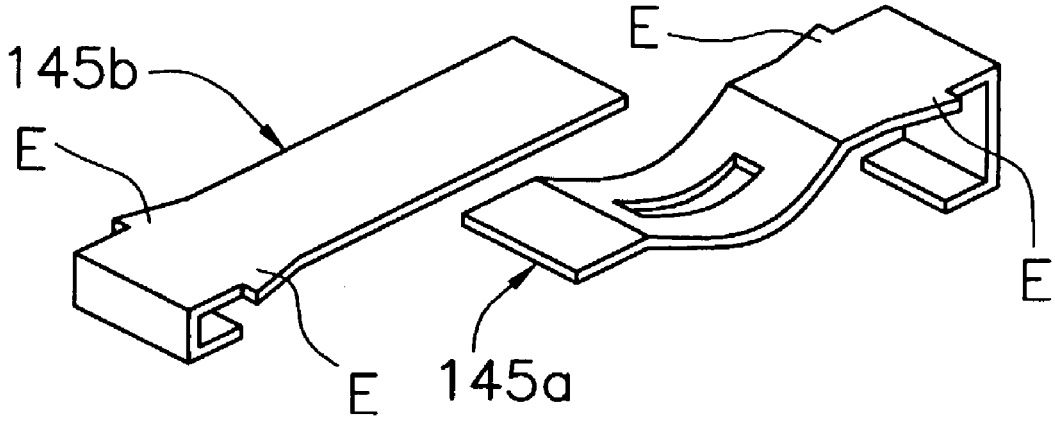
FIG. 19 is a schematic view showing a modification of a pair of metal terminals used in preferred embodiments of the present invention.

In the above-described first to eleventh preferred embodiments, like the upper-side metal terminal 145*a* and the lower-side metal terminal 145*b* shown in FIG. 19, it is desirable that the upper and lower metal terminal have wider portions E provided at locations that are in contact with the inner wall surfaces of the end surfaces 24*e* and 24*f*, the end faces 34*e* and 34*f*, the end surfaces 64*e* and 64*f*, the end faces 74*e* and 74*f*, the end faces 84*e* and 84*f*, the end surfaces 94*e* and 94*f*, and the end surfaces 104*e* and 104*f*, respectively, in order to prevent these upper and lower metal terminals from falling out of the terminal insertion holes 27*a* and 27*b*, respectively, of the terminal insertion holes of the insulating cases 24, 34, 44, 64, 74, 84, 94, and 104, and the terminal holes 37*a* and 37*b* of the insulating case 74. This wider portion E gradually increases in width from one end portion toward the other end portion thereof.

In FIG. 19, the maximum width of the wider portion E is preferably approximately 2.6 mm with the width of the upper and lower metal surfaces 145*a* and 145*b* being about 2.2 mm.

Figure 20:
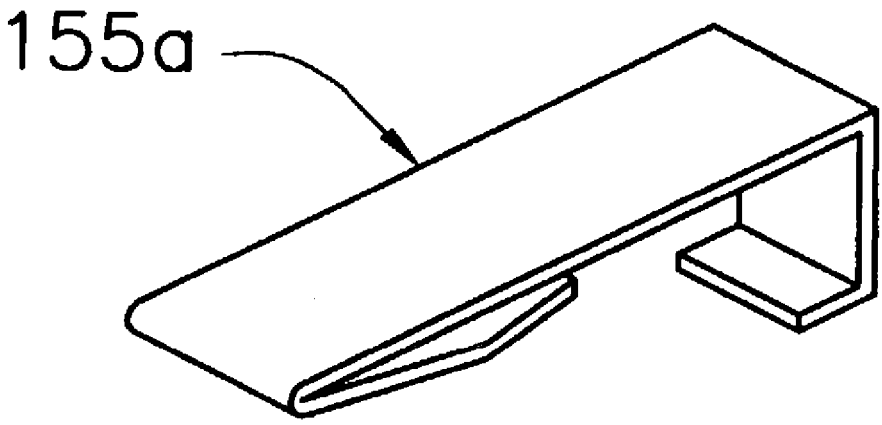
FIG. 20 is a schematic view showing a modification of an upper-side metal terminal of a preferred embodiment of the present invention.

The upper-side metal terminal has spring properties. For example, a metal surface having a shape similar to the upper-side metal terminal 155*a* shown in FIG. 20 may also be used.

Figure 23:
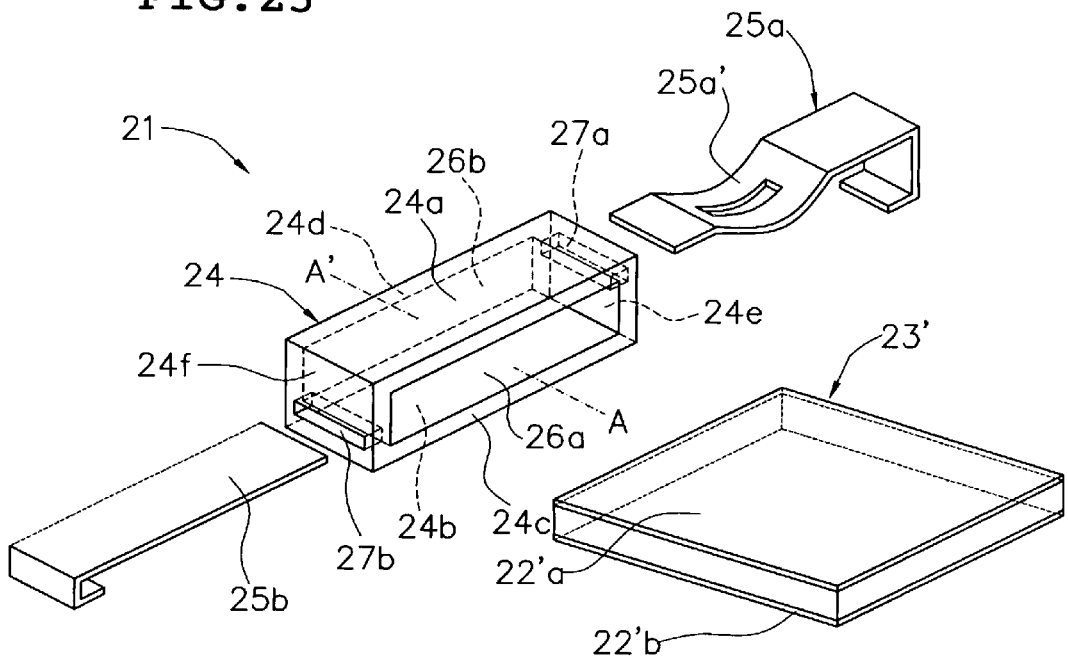
FIG. 23 is a schematic exploded view showing a surface-mount positive temperature coefficient thermistor according to a modified preferred embodiment of the present invention.

In each of the above-described preferred embodiments, a disk unit has been used for the positive temperature coefficient thermistor element. However, in the present invention, the shape of the positive temperature coefficient thermistor element is not limited to a disk shape. For example, a plate having a substantially square or rectangular shape in a plan view may also be used for the positive temperature coefficient thermistor element as shown in FIG. 23.

As described above, according to the surface-mount positive temperature coefficient thermistor of the present invention, since the terminal insertion holes in the respective opposite end surfaces of the insulating case having a substantially rectangular shape, are arranged so as to be rotated with respect to each other by an angle of about 180 degrees about the axis connecting the centers of the pair of opening side surfaces, the orientation of the insulating case is irrelevant when inserting the terminals into the insulating case, thereby increasing the working efficiency.

The present invention enables the positive temperature coefficient thermistor element and the upper and lower terminals to be reliably brought into pressure contact with each other using only a single case, without the need to engage a locking portion and a cover portion. This facilitates the manufacture of the present surface-mount positive temperature coefficient thermistor and reduces the manufacturing cost thereof.

Since the terminal insertion holes in the opposite end surfaces of the insulating case are configured so as not to affect the strength of the insulating case, the case maintains sufficient strength even if the thickness of the case 24 is reduced.

According to the manufacturing method for the surface-mount positive temperature coefficient thermistor according to another preferred embodiment of the present invention, only the lower-side metal terminal, positive temperature coefficient thermistor element, and upper-side metal terminal must be inserted in this order into the single insulating case from respective directions different from each other. This eliminates the need for insert molding.

In the surface-mount positive temperature coefficient thermistor of various preferred embodiments of the present invention, when the terminal insertion holes are provided in two portions in the opposite end surfaces of the insulating case, and these two groups of two terminal insertion holes are arranged such that one of the two groups is rotated with respect to the other of the two groups by an angle of about 180 degrees about the axes each connecting the centers of the opposite main surfaces, opposite opening side surfaces, and opposite end surfaces of the insulating case 34, there is no need to consider the orientation of the insulating case when inserting the terminals into the insulating case. This provides an increased working efficiency.

According to the surface-mount positive temperature coefficient thermistor of preferred embodiments of the present invention, by providing a projection on the tabular portion of the lower-side metal terminal to engage the projection with the recess provided in a main surface of the positive temperature coefficient thermistor element, the positional deviation of the positive temperature coefficient thermistor element caused by vibrations or shocks is prevented.

Furthermore, according to the surface-mount positive temperature coefficient thermistor of preferred embodiments of the present invention, providing, within the insulating case or/and on one of the pair of metal terminals, locking portions that make contact with the side surface of the positive temperature coefficient thermistor element in order to position the positive temperature coefficient thermistor, also prevents positional deviation of the positive temperature coefficient thermistor element, and offers advantages in not imposing substantial strain on the mold structure and improving the mass-productivity when manufacturing the insulating case and metal terminals.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. A surface-mount positive temperature coefficient thermistor, comprising:

a disk-shaped positive temperature coefficient thermistor element having electrodes provided on opposing main surfaces thereof; and an insulating case having an inner space with said positive temperature coefficient thermistor element inserted therein, and in which a pair of metal terminals are inserted, said pair of metal terminals being arranged to make electrical contact with the respective main surface electrodes of said positive temperature coefficient thermistor element, and to sandwich therebetween said positive temperature coefficient thermistor element in said inner space; wherein said insulating case includes a pair of main surfaces that are substantially parallel to the opposite main surfaces of said positive temperature coefficient thermistor element disposed in said inner space, a pair of opening side surfaces each having an opening portion where said inner space of the insulating case is exposed to the outside, and a pair of end surfaces each having a terminal insertion hole provided therein;

the pair of end surfaces are disposed at opposite ends of the pair of main surfaces;

each of the terminal insertion holes extends entirely through a respective one of the pair of end surfaces from outside the insulating case to the inner space of the insulating case; and one end portion of each of said pair of metal terminals is inserted into the inner space of said insulating case from outside the insulating case via a respective one of said terminal insertion holes provided in the pair of end surfaces of said insulating case, and wherein the other end of each of said pair of metal terminals extends to one of the main surfaces along the outer wall surface of said insulating case.

2. The surface-mount positive temperature coefficient thermistor according to claim 1, wherein said terminal insertion holes are provided in two portions of the pair of end surfaces of said insulating case.

3. The surface-mount positive temperature coefficient thermistor according to claim 1, wherein an extension portion extending from one of said pair of main surfaces is provided on each side of said pair of opening side surfaces of said insulating case, and wherein a protrusion is provided at a front end of each of said extension portions; and wherein said protrusions are provided at location which are point-symmetrical with respect to a center of said positive temperature coefficient thermistor element.

4. The surface-mount positive temperature coefficient thermistor according to claim 1, wherein an extension portion extending from one of said pair of main surfaces and an extension portion extending from the other of said pair of main surfaces are each provided on a respective one of the sides of said opening side surfaces of said insulating case, and wherein a protrusion is provided at a front end of each of said extension portions; and said protrusions are provided at locations which are line-symmetrical with respect to a center line that passes through one end surface of said insulating case, the center of said positive temperature coefficient thermistor element, and the other end surface of said insulating case.

5. The surface-mount positive temperature coefficient thermistor according to claim 1, wherein looking portions that make contact with the side surface of said positive temperature coefficient thermistor element in order to position said positive temperature coefficient thermistor element are provided within said insulating case and on one of said pair of metal terminals.

6. The surface-mount positive temperature coefficient thermistor according to claim 1, wherein locking portions that make contact with the side surface of said positive temperature coefficient thermistor element in order to position said positive temperature coefficient thermistor element are provided within said insulating case or on one of said pair of metal terminals.

7. The surface-mount positive temperature coefficient thermistor according to claim 5, wherein, at least one locking portion is provided within said insulating case and includes a projection provided on the inner wall surface of said insulating case, said projection being arranged so as to be opposed to the side surface of the positive temperature coefficient thermistor element;

at least one locking portion is provided on said metal terminal and is one of a folded portion and a cut-and-raised portion; and said one of said folded portion and said cut-and-raised portion is arranged so as to be opposed to the side surface of the positive temperature coefficient thermistor element.

8. The surface-mount positive temperature coefficient thermistor according to claim 7, wherein, on the inner wall surface within said insulating case, said projection provided in said insulating case, or said one of said folded portion and said cut-and-raised portion provided on said metal terminal is disposed at a location where the end surfaces and the opening side surfaces of said insulating case intersect one another.

9. The surface-mount positive temperature coefficient thermistor according to claim 1, wherein, one of said pair of metal terminals is a tabular terminal and the other of said pair of metal terminals is a spring terminal; and a projection is provided on said one of said pair of metal terminals, and a recess is provided in a main surface of said positive temperature coefficient thermistor element and is engaged with said projection.

10. The surface-mount positive temperature coefficient thermistor according to claim 9, wherein a pair of protuberances for contacting a main surface of said positive temperature coefficient thermistor element are provided around said projection provided on the tabular portion of said one of said pair of metal terminals.

11. The surface-mount positive temperature coefficient thermistor according to claim 1, wherein each of said pair of metal terminals includes a wider portion arranged to be in contact with the inner wall surface of the end surface of said insulating case.

12. A surface-mount positive temperature coefficient thermistor, comprising:

a plate-shaped positive temperature coefficient thermistor element having electrodes provided on opposing main surfaces thereof; and an insulating case including an inner space with said positive temperature coefficient thermistor element inserted therein, and in which a pair of metal terminals are inserted, said pair of metal terminals being arranged to make electrical contact with said respective main surface electrodes of said positive temperature coefficient thermistor element, and to sandwich therebetween said positive temperature coefficient thermistor element in said inner space; wherein said insulating case includes a pair of main surfaces that are substantially parallel to the opposite main surfaces of said positive temperature coefficient thermistor element disposed in said inner space, a pair of opening side surfaces each having an opening portion where said inner space of the insulating case is exposed to the outside, and a pair of end surfaces each having a terminal insertion hole provided therein;

the pair of end surfaces are disposed at opposite ends of the pair of main surfaces;

each of the terminal insertion holes extends entirely through a respective one of the pair of end surfaces from outside the insulating case to the inner space of the insulating case; and one end portion of each of said pair of metal terminals is inserted into the inner space of said insulating case from outside the insulating case via a respective one of said terminal insertion holes provided in the pair of end surfaces of said insulating case, and the other end of each of said pair of metal terminals extends to one of the main surfaces along the outer wall surface of said insulating case.

13. The surface-mount positive temperature coefficient thermistor according to claim 12, wherein said terminal insertion holes are provided in two portions of the pair of end surfaces of said insulating case.

14. The surface-mount positive temperature coefficient thermistor according to claim 12, wherein an extension portion extending from one of said pair of main surfaces is provided on each side of said pair of opening side surfaces of said insulating case, and wherein a protrusion is provided at a front end of each of said extension portions; and wherein said protrusions are provided at location which are point-symmetrical with respect to a center of said positive temperature coefficient thermistor element.

15. The surface-mount positive temperature coefficient thermistor according to claim 12, wherein an extension portion extending from one of said pair of main surfaces and an extension portion extending from the other of said pair of main surfaces are each provided on a respective one of the sides of said opening side surfaces of said insulating case, and wherein a protrusion is provided at a front end of each of said extension portions; and said protrusions are provided at locations which are line-symmetrical with respect to a center line that passes through one end surface of said insulating case, the center of said positive temperature coefficient thermistor element, and the other end surface of said insulating case.

16. The surface-mount positive temperature coefficient thermistor according to claim 12, wherein locking portions that make contact with the side surface of said positive temperature coefficient thermistor element in order to position said positive temperature coefficient thermistor element are provided within said insulating case and on one of said pair of metal terminals.

17. The surface-mount positive temperature coefficient thermistor according to claim 12, wherein locking portions that make contact with the side surface of said positive temperature coefficient thermistor element in order to position said positive temperature coefficient thermistor element are provided within said insulating case or on one of said pair of metal terminals.

18. The surface-mount positive temperature coefficient thermistor according to claim 16, wherein, at least one locking portion is provided within said insulating case and includes a projection provided on the inner wall surface of said insulating case, said projection being arranged so as to be opposed to the side surface of the positive temperature coefficient thermistor element;

at least one locking portion is provided on said metal terminal and is one of a folded portion and a cut-and-raised portion; and said one of said folded portion and said cut-and-raised portion is arranged so as to be opposed to the side surface of the positive temperature coefficient thermistor element.

19. The surface-mount positive temperature coefficient thermistor according to claim 18, wherein, on the inner wall surface within said insulating case, said projection provided in said insulating case, or said one of said folded portion and said cut-and-raised portion provided on said metal terminal is disposed at a location where the end surfaces and the opening side surfaces of said insulating case intersect one another.

20. The surface-mount positive temperature coefficient thermistor according to claim 12, wherein, one of said pair of metal terminals is a tabular terminal and the other of said pair of metal terminals is a spring terminal; and a projection is provided on said one of said pair of metal terminals, and a recess is provided in a main surface of said positive temperature coefficient thermistor element and is engaged with said projection.

21. The surface-mount positive temperature coefficient thermistor according to claim 20, wherein a pair of protuberances for contacting a main surface of said positive temperature coefficient thermistor element are arranged around said projection provided on the tabular portion of said one of said pair of metal terminals.

22. The surface-mount positive temperature coefficient thermistor according to claim 12, wherein each of said pair of metal terminals includes a wider portion arranged to be in contact with the inner wall surface of the end surface of said insulating case.

* * * * *